US007423593B2

(12) United States Patent
Puente Baliarda et al.

(10) Patent No.: US 7,423,593 B2
(45) Date of Patent: Sep. 9, 2008

(54) BROADSIDE HIGH-DIRECTIVITY MICROSTRIP PATCH ANTENNAS

(76) Inventors: Carles Puente Baliarda, Londres 57 4th 2nd San Cugat del Valles, Barcelona (ES) 08036; Jaume Anguera Pros, P. Blasco Ibanez N. 15 2nd , Vinarós (ES) 12500; Carmen Borja Borau, Tvra. de Dalt, 67, Barcelona (ES) 08024

( * ) Notice: Subject to any disclaimer, the term of this patent is extended or adjusted under 35 U.S.C. 154(b) by 0 days.

(21) Appl. No.: 11/186,538

(22) Filed: Jul. 21, 2005

(65) Prior Publication Data

US 2005/0285795 A1 Dec. 29, 2005

(51) Int. Cl.
*H01Q 1/38* (2006.01)

(52) U.S. Cl. ..... 343/700 MS

(58) Field of Classification Search ..... 343/700 MS, 343/833, 834

See application file for complete search history.

(56) References Cited

U.S. PATENT DOCUMENTS

| | | | | |
|---|---|---|---|---|
| 4,197,544 | A | 4/1980 | Kaloi | |
| 5,220,335 | A * | 6/1993 | Huang | 343/700 MS |
| 5,497,164 | A | 3/1996 | Croq | |
| 5,576,718 | A * | 11/1996 | Buralli et al. | 343/700 MS |
| 5,627,550 | A | 5/1997 | Sanad | |
| 5,657,028 | A | 8/1997 | Sanad | |
| 5,680,144 | A | 10/1997 | Sanad | |
| 5,903,240 | A | 5/1999 | Kawahata et al. | |
| 5,955,994 | A * | 9/1999 | Staker et al. | 343/700 MS |
| 5,986,609 | A | 11/1999 | Spall | |
| 6,049,314 | A | 4/2000 | Munson et al. | |
| 6,075,485 | A | 6/2000 | Lilly et al. | |
| 6,104,349 | A | 8/2000 | Cohen | |
| 6,127,977 | A | 10/2000 | Cohen | |
| 6,133,882 | A | 10/2000 | LaFleur et al. | |
| 6,133,883 | A | 10/2000 | Munson et al. | |
| 6,140,975 | A | 10/2000 | Cohen | |
| 6,160,513 | A | 12/2000 | Davidson et al. | |
| 6,181,281 | B1 | 1/2001 | Desclos et al. | |

(Continued)

FOREIGN PATENT DOCUMENTS

EP 0753897 A2 1/1997

(Continued)

OTHER PUBLICATIONS

Borja, C. et al., "High directivity fractal boundary microstrip patch antenna," Electronics Letters, vol. 36, No. 9, Apr. 27, 2000 (2 pp.).

(Continued)

*Primary Examiner*—Michael C Wimer

(57) ABSTRACT

High-directivity microstrip antennas comprising a driven patch and at least one parasitic element placed on the same plane, operate at a frequency larger than the fundamental mode of the driven patch in order to obtain a resonant frequency with a high-directivity broadside radiation pattern. The driven patch, the parasitic elements and the gaps between them may be shaped as multilevel and/or Space Filling geometries. The gap defined between the driven and parasitic patches according to the invention is used to control the resonant frequency where the high-directivity behaviour is obtained. The invention provides that with one single element is possible to obtain the same directivity than an array of microstrip antennas operating at the fundamental mode.

28 Claims, 10 Drawing Sheets

U.S. PATENT DOCUMENTS

| | | | | |
|---|---|---|---|---|
| 6,198,438 | B1 * | 3/2001 | Herd et al. | 343/700 MS |
| 6,211,825 | B1 | 4/2001 | Deng | |
| 6,281,848 | B1 | 8/2001 | Nagumo | |
| 6,326,927 | B1 | 12/2001 | Johnson et al. | |
| 6,337,662 | B1 | 1/2002 | Cassel | |
| 6,388,620 | B1 | 5/2002 | Bhattacharyya | |
| 6,407,705 | B1 * | 6/2002 | Sanad | 343/700 MS |
| 6,421,014 | B1 | 7/2002 | Sanad | |
| 6,452,553 | B1 | 9/2002 | Cohen | |
| 6,470,174 | B1 | 10/2002 | Schefte et al. | |
| 6,476,766 | B1 | 11/2002 | Cohen | |
| 6,498,586 | B2 | 12/2002 | Pankinaho | |
| 6,509,882 | B2 | 1/2003 | McKivergan | |
| 6,525,691 | B2 * | 2/2003 | Varadan et al. | 343/700 MS |
| 6,618,017 | B1 | 9/2003 | Ryken | |
| 6,798,382 | B2 | 9/2004 | Edimo et al. | |
| 7,019,695 | B2 | 3/2006 | Cohen | |
| 2002/0075187 | A1 | 6/2002 | McKivergan | |
| 2002/0140615 | A1 | 10/2002 | Carles et al. | |
| 2004/0104851 | A1 | 6/2004 | Kadambi | |

FOREIGN PATENT DOCUMENTS

| | | | |
|---|---|---|---|
| EP | 0929121 | | 7/1999 |
| EP | 1091445 | | 4/2001 |
| EP | 1148581 | | 10/2001 |
| EP | 1294049 | A1 | 3/2003 |
| EP | 1357634 | | 10/2003 |
| EP | 1414106 | A1 | 4/2004 |
| JP | 2001/007639 | A | 1/2001 |
| WO | 9706578 | | 2/1997 |
| WO | 9834295 | A1 | 8/1998 |
| WO | 9933143 | | 7/1999 |
| WO | 0128035 | A1 | 4/2001 |
| WO | 0154225 | | 7/2001 |
| WO | 02063714 | | 8/2002 |
| WO | 03034545 | | 4/2003 |
| WO | 03041216 | | 5/2003 |
| WO | 2004010535 | | 1/2004 |

OTHER PUBLICATIONS

Hara Prasad, R.V. et al., "Mircostrip fractal patch antenna for multiband communication," Electronics Letters, vol. 36, No. 14, Jul. 6, 2000 (2 pp.).

Anguera, Jaume et al., "Small and High-Directivity Bow-Tie Patch Antenna Based on the Sierpinski Fractal", Microwave and Optical Technology Letters, vol. 31, No. 3, Nov. 5, 2001, pp. 239-241.

Bafrooei, Pedram Moosavi et al., "Characteristics of Single- and Double-Layer Microstrip Square-Ring Antennas", IEEE Transactions on Antennas and Propagation, vol. 47, No. 10, Oct. 1999, pp. 1633-1639.

Borja, Carmen et al., "Fractal Multiband Patch Antenna", Dept. of Signal Theory and Communmications, Universitat Politecnica de Catalunya (UPC), undated, 4 pp.

Borja, C. et al., "Multiband Sierpinski Fractal Patch Antenna", Electromagnetics & Photonics Engineering Group, Dept. of Signal Theory and Communications, Universitat Politecnica de Catalunya (UPC), undated, 4 pp.

Carver, Keith R. et al., "Microstrip Antenna Technology", IEEE Transactions on Antennas and Propagation, vol. AP-29, No. 1, Jan. 1981, pp. 2-24.

Chang, Jungmin et al., "Hybrid Fractal Cross Antenna", Microwave and Optical Technology Letters, vol. 25, No. 6, Jun. 20, 2000, pp. 429-435.

Chow, Yan Wai et al., "An Innovative Monopole Antenna for Mobile-Phone Handsets", Microwave and Optical Technology Letters, vol. 25, No. 2, Apr. 20, 2000, pp. 119-121.

Huang, John et al., "Microstrip Yagi Array Antenna for Mobile Satellite Vehicle Application", IEEE Transactions on Antennas and Propagation, vol. 39, No. 7, Jul. 1991, pp. 1024-1030.

Huang, John, "A Ka-Band Circularly Polarized High-Gain Microstrip Array Antenna", IEEE Transactions on Antennas and Propagation, vol. 43, No. 1, Jan. 1995, pp. 113-116.

Iwasaki, Hisao et al., "Electromagnetically Coupled Circular-Patch Antenna Consisting of Multilayered Configuration", IEEE Transactions on Antennas and Propagation, vol. 44, No. 6, Jun. 1996, pp. 777-780.

Kumar, Girish et al., "Nonradiating Edges and Four Edges Gap-Coupled Multiple Resonator Broad-Band Microstrip Antennas", IEEE Transactions on Antennas and Propagation, vol. AP-33, No. 2, Feb. 1985, pp. 173-178.

Lee, Choon Sae et al., "Planar Circularly Polarized Microstrip Antenna with a Single Feed", IEEE Transactions on Antennas and Propagation, vol. 47, No. 6, Jun. 1999, pp. 1005-1007.

Liu, Zi Dong et al., "Dual-Frequency Planar Inverted-F Antenna", IEEE Transactions on Antennas and Propagation, vol. 45, No. 10, Oct. 1997, pp. 1451-1458.

Montesinos, Gemma et al., "The Sierpinski fractal bowtie patch: a multifraction-mode antenna", IEEE Transactions on Antennas and Propagation, 2002, pp. 542-545.

Pan, Shan-Cheng et al., "Dual-Frequency Triangular Microstrip Antenna with a Shorting Pin", IEEE Transactions on Antennas and Propagation, vol. 45, No. 12, Dec. 1997, pp. 1889-1891.

Papapolymerou, Ioannis et al., "Micromachined Patch Antennas", IEEE Transactions on Antennas and Propagation, vol. 46, No. 2, Feb. 1998, pp. 275-283.

Reddy, K.T.V. et al., "Stacked Microstrip Antennas for Broadband Circular Polarization", IEEE Transactions on Antennas and Propagation, Jan. 2001, pp. 420-423.

Sanad, Mohamed, "A Compact Dual-Broadband Microstrip Antenna Having Both Stacked and Planar Parasitic Elements", IEEE Transactions on Antennas and Propagation, 1996, pp. 6-9.

Wang, Hanyang Y. et al., "Aperture-Coupled Thin-Film Superconducting Meander Antennas", IEEE Transactions on Antennas and Propagation, vol. 47, No. 5, May 1999, pp. 829-836.

Zaman, A. et al., Stacked Electromagnetically Coupled Rectangular Patch Antenna With Segmented Elements, 2000 USNC/URSI Radio Science Meeting Digest, 2000. p. 317.

Reed, S. et al., Antenna patch reduction by inductive and capacitive loading, 2000 USNC/URSI Radio Science Meeting Digest, 2000. p. 318.

Ollikainen, J. et al. Radiation and bandwidth characteristics of planar multistripantennas for mobile communication systems. Vehicular Technology Conference, 48th IEEE, May 1998, vol. 2.

Sanad, M. et al. Compact internal multiband microstrip antennas for portable GPS, PCS, cellular and satellite phones, Microwave Journal, Aug. 1999, vol. 42, No. 8.

Fang, S. Planar inverted-F antennas for GSM/DCS mobile phones and dual ISM-band applications, Antennas and Propagation Society International Symposium, 2002, vol. 4.

Cho, M. Modified slot-loaded triple-band microstrip patch antennas, Antennas and Propagation Society International Symposium, 2002, vol. 3.

Wong, K.L. Planar antenna for wireless communications, Jonh Wiley & Sons, 2003.

Moleiro, A. Dual band microstrip patch antenna element with parasitic for GSM, Antennas and Propagation Society International Symposium, 2000, vol. 4.

Sanad, M. A compact dual-broadband microstrip antenna having both stacked and planar parasitic elements, Antennas and Propagation Society International Symposium, 1996, vol. 1.

Minh-Chau T. Huynh, A numerical and experimental investigation of planar inverted-F antennas for wireless communication antennas, Virginia Polytechnic Institute and State University, Oct. 2000.

Font, G. Antenes microstrip multifreqüència utilizant elements paràsits, carregats i fractals (Multifrequency microstrip antennas using parasitic, loading and fractal elements), Universitat Politécnica de Catalunya, Jun. 2002.

Desclos, L. et al., An interdigitated printed antenna for PC card applications, IEEE Transactions on Antennas and Propagation, Sep. 1998, vol. 46, No. 9.

Salonen, P. et al., Dual-band and wide-band PIFA with U and meanderline-shaped slots, IEEE Antennas and Propagation Society International Symposium, 2001, vol. 2.

Carver, K.R., "Microstrip antenna technology" in Microstrip antennas. The analysis and design of microstrip antennas and arrays, Pozar; Schaubert; IEEE Antennas and Propagation Society, 1995, p. 3-26.

Borja, Carmen et al. "Fracton vibration modes in the Sierpinski microstrip patch antenna", IEEE Antennas and Propagation Society International Symposium, 2001, 4 pp.

Pozar, David M., "Microstrip Antennas", Proceedings of the IEEE, vol. 80, No. 1, Jan. 1992, pp. 79-91.

Pribetich, P. et al., "A New Planar Microstrip Resonator for Microwave Circuits: The Quasi-Fractal Microstrip Resonator", 29th European Microwave Conference- Munich, 1999, pp. 333-336.

Romeu, Jordi et al., "High directivity modes in the Koch island fractal patch antenna", IEEE Antennas and Propagation Society International Symposium, 2000, 4 pp.

Wong, Kin-Lu, "Compact and Broadband Microstrip Antennas", John Wiley & Sons, Inc., 2002, pp. v-xi and 1-327.

* cited by examiner

BROADSIDE HIGH-DIRECTIVITY MICROSTRIP PATCH ANTENNAS

OBJECT OF THE INVENTION

The present invention refers to high-directivity microstrip antennas having a broadside radiation pattern using electromagnetically coupled elements. A broadside radiation pattern is defined in the present invention as a radiation pattern having the maximum radiation in the direction perpendicular to the patch surface.

The advantage of an antenna having a broadside radiation pattern with a larger directivity than that of the fundamental mode, is that with one single element it is possible to obtain the same directivity as an array of microstrip antennas operating at the fundamental mode, the fundamental mode being the mode that presents the lowest resonant frequency, but there is no need to employ a feeding network. With the proposed microstrip antenna, there are no losses due to the feeding network and therefore a higher gain can be obtained.

BACKGROUND OF THE INVENTION

The conventional mechanism to increase directivity of a single radiator is to array several elements (antenna array) or increase its effective area. This last solution is relative easily for aperture antennas such as horns and parabolic reflectors for instance. However, for microstrip antennas, the effective area is directly related to the resonant frequency, i.e., if the effective area is changed, the resonant frequency of the fundamental mode also changes. Thus, to increase directivity for microstrip antennas, a microstrip array has to be used. The problem of a microstrip array is that it is necessary to feed a large number of elements using a feeding network. Such feeding network adds complexity and losses causing a low antenna efficiency.

As a consequence, it is highly desirable for practical applications to obtain a high-directivity antenna with a single fed antenna element. This is one of the purposes of the present invention.

Several approaches can be found in the prior art, as for example a microstrip Yagi-array antenna [J. Huang, A. Densmore, "Microstrip Yagi Array Antenna for Mobile Satellite Vehicle Application", IEEE Transactions on Antennas and Propagation, vol. 39, n° 7, July 1991]. This antenna follows the concept of Yagi-Uda antenna where directivity of a single antenna (a dipole in the classical Yagi-Uda array) can be increased by adding several parasitic elements called director and reflectors. This concept has been applied for a mobile satellite application. By choosing properly the element spacing (around $0.35\lambda_o$ being $\lambda_o$ the free-space wavelength), directivity can be improved.

However, this solution presents a significant drawback: if a substrate with a low dielectric constant is used in order to obtain large bandwidth, the patch size is larger than the above mentioned element spacing of around $0.35\lambda_o$: the required distance can no longer be held. On the other hand, if a substrate with a high dielectric constant is used in order to reduce antenna size, the patch size is small and the coupling between elements will be insufficient for the Yagi effect function. In conclusions, although this may be a good practical solution for certain applications, it presents a limited design freedom.

Another known technique to improve directivity is to use several parasitic elements arranged on the same plane as the feed element (hereafter, the driven patch). This solution is specially suitable for broadband bandwidth. However, the radiation pattern changes across the band [G. Kumar, K. Gupta, "Non-radiating Edges and Four Edges Gap-Coupled Multiple Resonator Broad-Band Microstrip Antennas", IEEE Transactions on Antennas and Propagation, vol. 33, n° 2, February 1985].

A similar solution as the prior one, uses several parasitic elements on different layers [P. Lafleur, D. Roscoe, J.S. Wight, "Multiple Parasitic Coupling to an Outer Antenna Patch Element from Inner Patch Elements", U.S. patent application Ser. No. 09/217,903]. The main practical problem of this solution is that several layers are needed yielding a mechanical complex structure.

A novel approach to obtain high-directivity microstrip antennas employs the concept of fractal geometry [C. Borja, G. Font, S. Blanch, J. Romeu, "High directivity fractal boundary microstrip patch antenna", IEE Electronic Letters, vol. 26, n° 9, pp. 778-779, 2000], [J. Anguera, C. Puente, C. Borja, R. Montero, J. Soler, "Small and High Directivity Bowtie Patch Antenna based on the Sierpinski Fractal", Microwave and Optical Technology Letters, vol. 31, n° 3, pp. 239-241, November 2001]. Such fractal-shaped microstrip patches present resonant modes called fracton and fractinos featuring high-directivity broadside radiation patterns. A very interesting feature of these antennas is that for certain geometries, the antenna presents multiple high-directivity broadside radiation patterns due to the existence of several fracton modes [G. Montesinos, J. Anguera, C. Puente, C. Borja, "The Sierpinski fractal bowtie patch: a multifracton-mode antenna". IEEE Antennas and Propagation Society International Symposium, vol. 4, San Antonio, USA June 2002]. However, the disadvantage of this solution is that the resonant frequency where the directivity performance is achieved can not be controlled unless one changes the patch size dimensions.

Some interesting prior art antenna geometries, such as those based on space-filling and multilevel ones, are described in the PCT applications ["Multilevel Antennae", publication No.: WO0122528.], and ["Space-Filling Miniature Antennas", publication No.: WO0154225].

A multilevel structure for an antenna device, as it is known in the prior art, consists of a conducting structure including a set of polygons, all of said polygons featuring the same number of sides, wherein said polygons are electromagnetically coupled either by means of a capacitive coupling or ohmic contact, wherein the contact region between directly connected polygons is narrower than 50% of the perimeter of said polygons in at least 75% of said polygons defining said conducting multilevel structure. In this definition of multilevel structures, circles, and ellipses are included as well, since they can be understood as polygons with a very large (ideally infinite) number of sides. An antenna is said to be a multilevel antenna, when at least a portion of the antenna is shaped as a multilevel structure.

A space-filling curve for a space-filling antenna, as it is known in the prior art, is composed by at least ten segments which are connected in such a way that each segment forms an angle with their neighbours, i.e., no pair of adjacent segments define a larger straight segment, and wherein the curve can be optionally periodic along a fixed straight direction of space if and only if the period is defined by a non-periodic curve composed by at least ten connected segments and no pair of said adjacent and connected segments define a straight longer segment. Also, whatever the design of such SFC is, it can never intersect with itself at any point except the initial and final point (that is, the whole curve can be arranged as a closed curve or loop, but none of the parts of the curve can become a closed loop).

SUMMARY OF THE INVENTION

The present invention relates to broadside high-directivity microstrip patch antennas comprising one driven patch and at least one coupled parasitic patch (the basic structure), placed on the same layer and operating at a frequency larger than the fundamental mode. The fundamental mode being understood in the present invention, as the mode that presents the lowest resonant frequency.

One aspect of the present invention is to properly couple one or more parasitic microstrip patch elements to the driven patch, to increase the directivity of the single driven element.

Although the scheme of FIG. 2 is geometrically similar to other electromagnetically coupled schemes, especially those for broadband bandwidth, the difference here is that the antenna is operating at a higher mode, i.e., the resonant frequency is larger than the resonant frequency on the fundamental mode. Another difference with those structures of the prior art operating at the fundamental mode, is that in prior-art structures the gap between the driven and parasitic patches is adjusted to enlarge bandwidth; however, in the present invention the gap is not used for that purpose, but to control the resonant frequency where the high-directivity behaviour is obtained. In other words, for conventional electromagnetic schemes like that presented in FIG. 2, the gap is designed to maximize impedance bandwidth. For the present invention, given a driven and parasitic patch sizes, the shape and dimensions of the gap between them can be chosen to control the resonant frequency where the high-directivity behaviour is obtained.

FIG. 1 shows a driven and a parasitic patch where the gap between them is defined by a space-filling curve. Comparing the structure of FIG. 1 and FIG. 2, resonant frequencies associated with the high-directivity broadside radiation pattern is different. To add more design freedom, several electromagnetic coupled parasitic patches may be added to the driven element.

A particular embodiment of the basic structure of the invention based on a driven element and at least a parasitic patch, may be defined according to a further aspect of the invention to obtain a multifunction antenna. A multifunction antenna is defined here as an antenna that presents a miniature feature at one frequency and a high-directivity radiation pattern at another frequency. For a multifunction antenna, the driven and parasitic patches are in contact using a short transmission line. This particular scheme is useful because it is possible to obtain a resonant frequency much lower than the fundamental mode of the driven element and maintain a resonant frequency with a high-directivity broadside radiation pattern.

A multifunction antenna is interesting for a dual band operation. For example, the first band is operating at GPS band where a miniature antenna is desired to minimize space; for the second band a high-directivity application may be required such an Earth-artificial satellite communication link.

Patch geometries may be any of the well-known geometries, such as squares, rectangles, circles, triangles, etc. However, other geometries such as those based on space-filling and multilevel geometries can be used as well. These geometries are described in the PCT publications WO0122528 "Multilevel Antennae", and WO0154225 "Space-Filling Miniature Antennas".

Some advantages of the present invention in comparison to the prior art are: it is mechanically simple because either the driven and the parasitic patches are placed on the same layer; the cost of the antenna is obviously related to the mechanical conception which is simple; the operating frequency is not only controlled by the patch dimensions, as it is the case of the prior art solution, in the present invention it is also controlled by the coupling between the driven and parasitic patches.

For example, for the prior-art multifracton-mode antenna, the patch electrical size where the high-directivity occurs is discrete; in the present invention, the gap configuration, between the driven and parasitic patches, is chosen to obtain a high-directivity broadside radiation pattern for a specified patch electrical size.

BRIEF DESCRIPTION OF THE DRAWINGS

To complete the description and with the object of assisting in a better understanding of the present invention and as an integral part of said description, the same is accompanied by a set of drawings wherein, by way of illustration and not restrictively, the following has been represented.

DETAILED DESCRIPTION OF THE PREFERRED EMBODIMENTS

Figure 1:
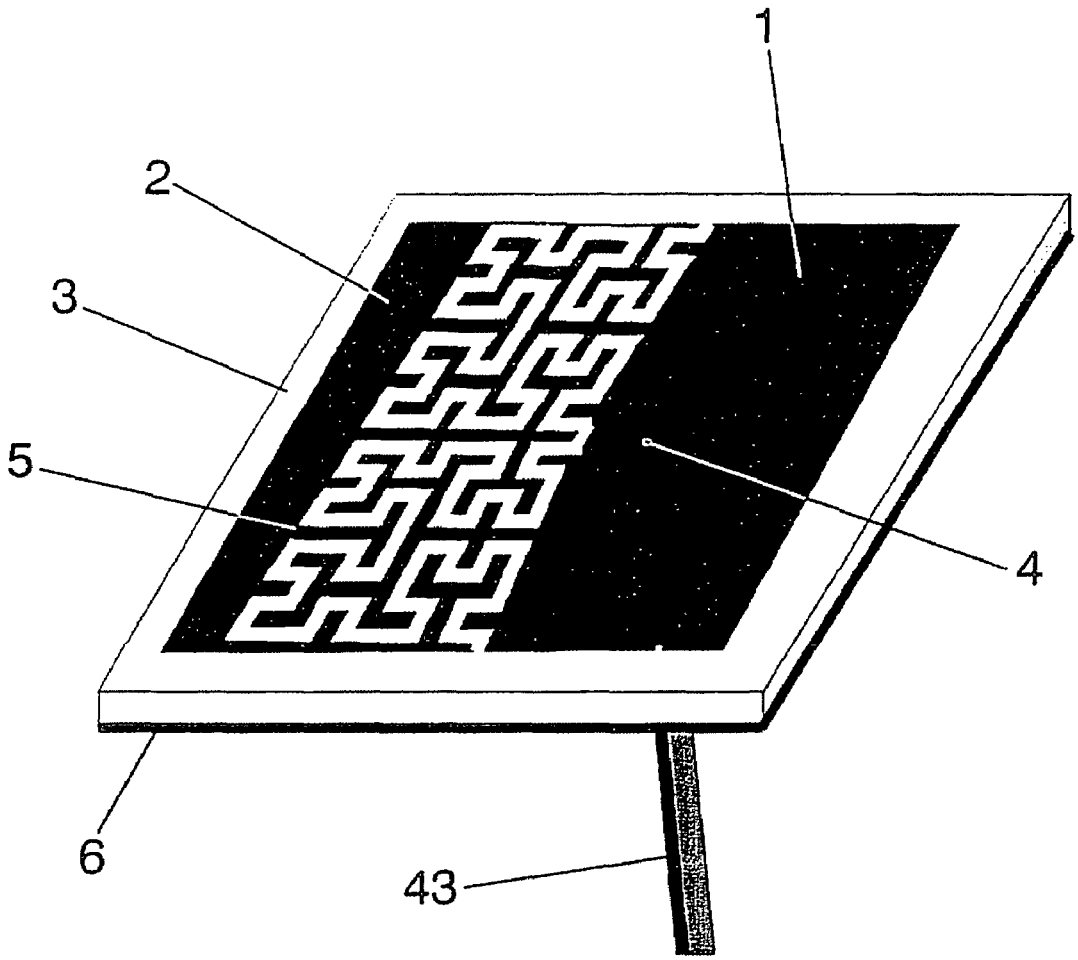
FIG. 1.—Shows a perspective view of a driven and a parasitic patch separated by a gap. Both patches are placed on the same plane defined by a substrate above a groundplane. A coaxial probe feed is used to feed the driven patch. The gap is defined by a space-filling curve.

FIG. 1 shows a preferred embodiment of the high-directivity antenna formed by a driven patch (1) and a parasitic patch (2) placed on the same substrate (3) above a groundplane (6). The said driven patch (1) and parasitic patch (2) can be printed over a dielectric substrate (3) or can be conformed through a laser process. Any of the well-known printed circuit fabrication techniques can be applied to pattern patch surface over the dielectric substrate (3). Said dielectric substrate (3) can be for instance a glass-fibre board, a teflon based substrate (such as Cuclad®) or other standard radiofrequency and microwave substrates (as for instance Rogers 4003® or Kapton®).

The dielectric substrate (3) can even be a portion of a window glass of a motor vehicle if the antenna is to be mounted in a motor vehicle such as a car, a train or an airplane, to transmit or receive radio, TV, cellular telephone (GSM 900, GSM 1800, UMTS) or other communication services of electromagnetic waves. Of course, a matching network can be connected or integrated at the input terminals (not shown) of the driven patch (1). The antenna mechanism described in the present invention may be useful for example for a Mobile Communication Base Station antenna where instead of using an array of antennas a single element may be used instead. This is an enormous advantage because there is no need to use a feeding network to feed the elements of the array. This results in a lesser complex antenna, less volume, less cost and more antenna gain. Another application may be used as a basic radiating element for an undersampled array, as the one described in the application PCT/EP02/0783 "Undersampled Microstrip Array Using Multilevel and Space-Filling Shaped Elements".

The feeding scheme for said driven patch can be taken to be any of the well-known schemes used in prior art patch antennas, for instance: in FIG. 1 a coaxial cable (43) with the outer conductor connected to the ground-plane (6) and the inner conductor connected to the driven patch (1) at the desired input resistance point (4). Of course the typical modifications including a capacitive gap on the patch around the coaxial connecting point (4) or a capacitive plate connected to the inner conductor of the coaxial placed at a distance parallel to the patch, and so on can be used as well. It could also consists of a microstrip transmission line sharing the same ground-plane as the driven patch antenna with the strip capacitively coupled to the driven patch and located at a distance below the said driven patch, or in another embodiment with the strip placed below the ground-plane and coupled to the driven patch through an slot, and even a microstrip transmission line with the strip co-planar to the driven patch. All these mechanisms are well known from prior art and do not constitute an essential part of the present invention.

Figure 6:
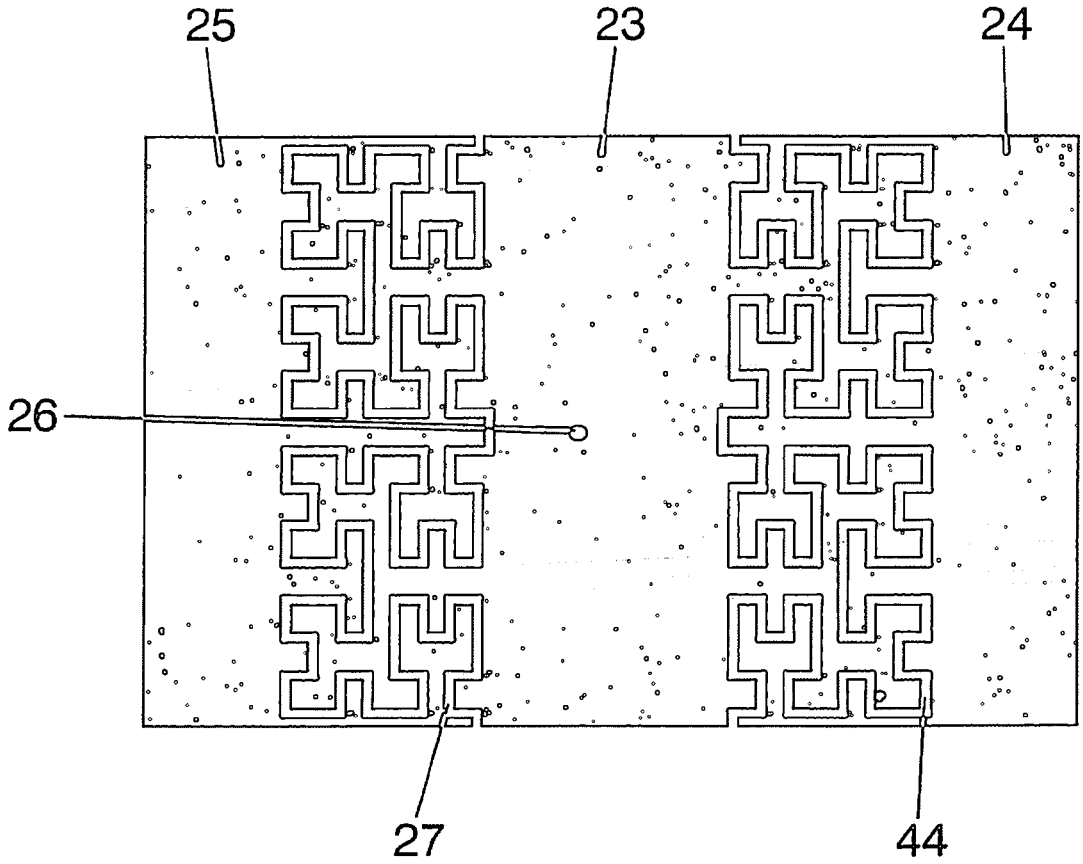
FIG. 6.—Shows a similar embodiment as FIG. 5 but two parasitic patches are coupled to the driven patch.

One of the main aspects of the present invention is to properly design the gap between patches to work in a high-frequency resonant frequency mode to obtain a high-directivity broadside radiation pattern. In FIG. 1 the gap (5) between the driven patch (1) and the parasitic patch (2) is defined by a space-filling curve based on the Hilbert fractal curve. FIG. 6 follows the same concept but in this case, two parasitic microstrip patches (24,25) are coupled to the driven patch (23) respectively through gaps (44) and (27). Gap or gaps can be placed anywhere on the patch surface, not necessary in the middle, that is the dimension of the driven and parasitic patches may be different. Moreover, the curve that is defining the gap or gaps between patches may present asymmetries with respect to a horizontal or vertical axis, in order to add more design freedom.

Figure 2:
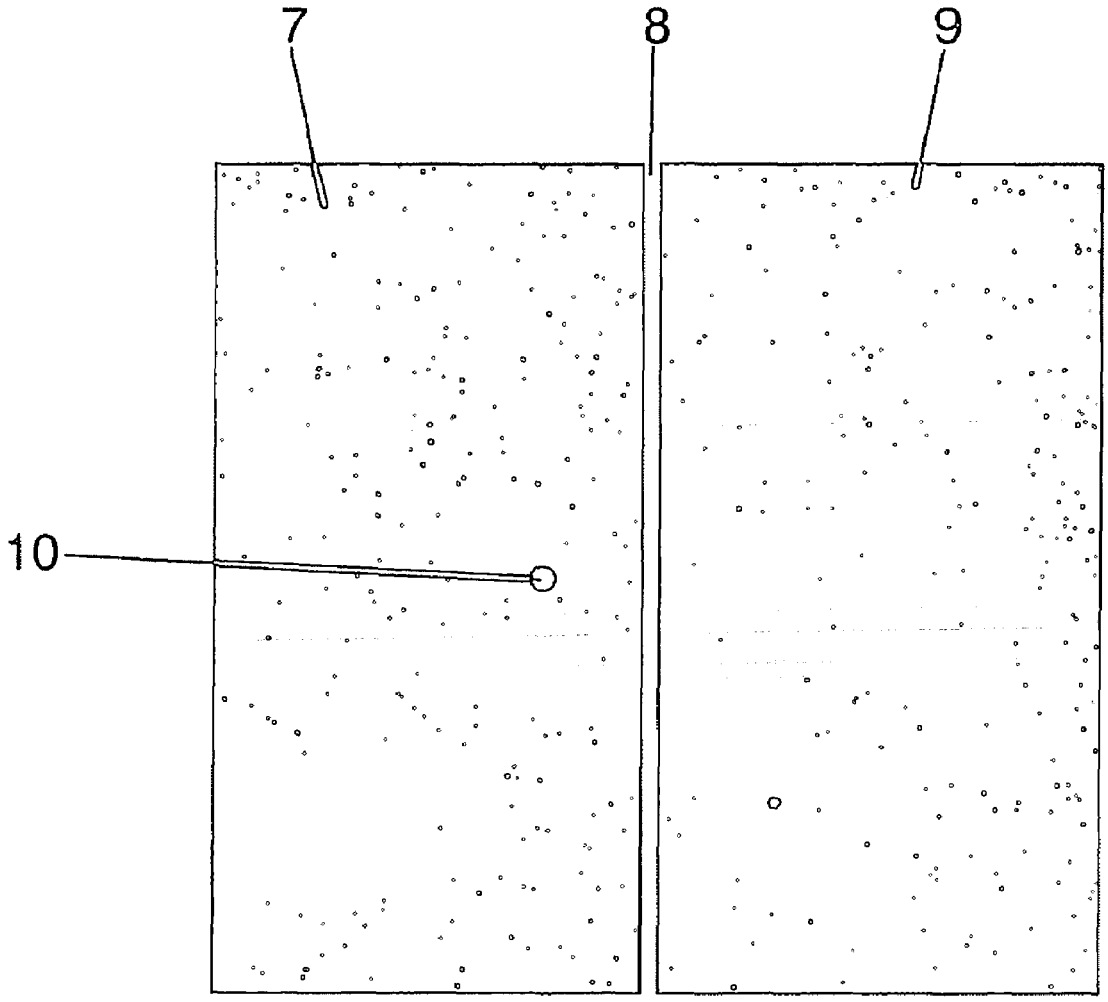
FIG. 2.—Shows a top plan view of a prior art structure formed by a driven and a parasitic patch where the gap is defined by a straight line. For the present invention this scheme differs from prior art, because the operating frequency is different than the frequency of the fundamental mode, that is, the operating frequency is larger than 20% of the fundamental mode of the driven patch.

FIG. 2 shows another preferred embodiment where in this case the gap (8) between driven patch (7) and parasitic patch (9) is defined by a straight line in order to reduce the coupling between said two patches. This is useful for frequency allocation of the resonant frequency where the high-directivity occurs. A feeding point (10) can be observed on the driven patch (7).

In an embodiment of the scheme of FIG. 2, the gap (8) between patches (7) and (9) was adjusted to be 0.1 mm where a high-directivity behaviour occurs around 11 GHz. The fundamental mode of the driven patch of FIG. 2 is around 4 GHz for a given patch size where it is clear that 11 GHz is a higher frequency mode. A prior-art scheme would operate at such frequency rather than 11 GHz and to achieve a broadband behaviour for standing wave ratios (SWR) lower than, the gap would be larger than 0.1 mm; otherwise the coupling between patches would be so tight that no broadband behaviour would be observed. To obtain a broadband behaviour for such case, gap between patches is around 0.5 mm (obviously these values are particular ones)

Figure 3:
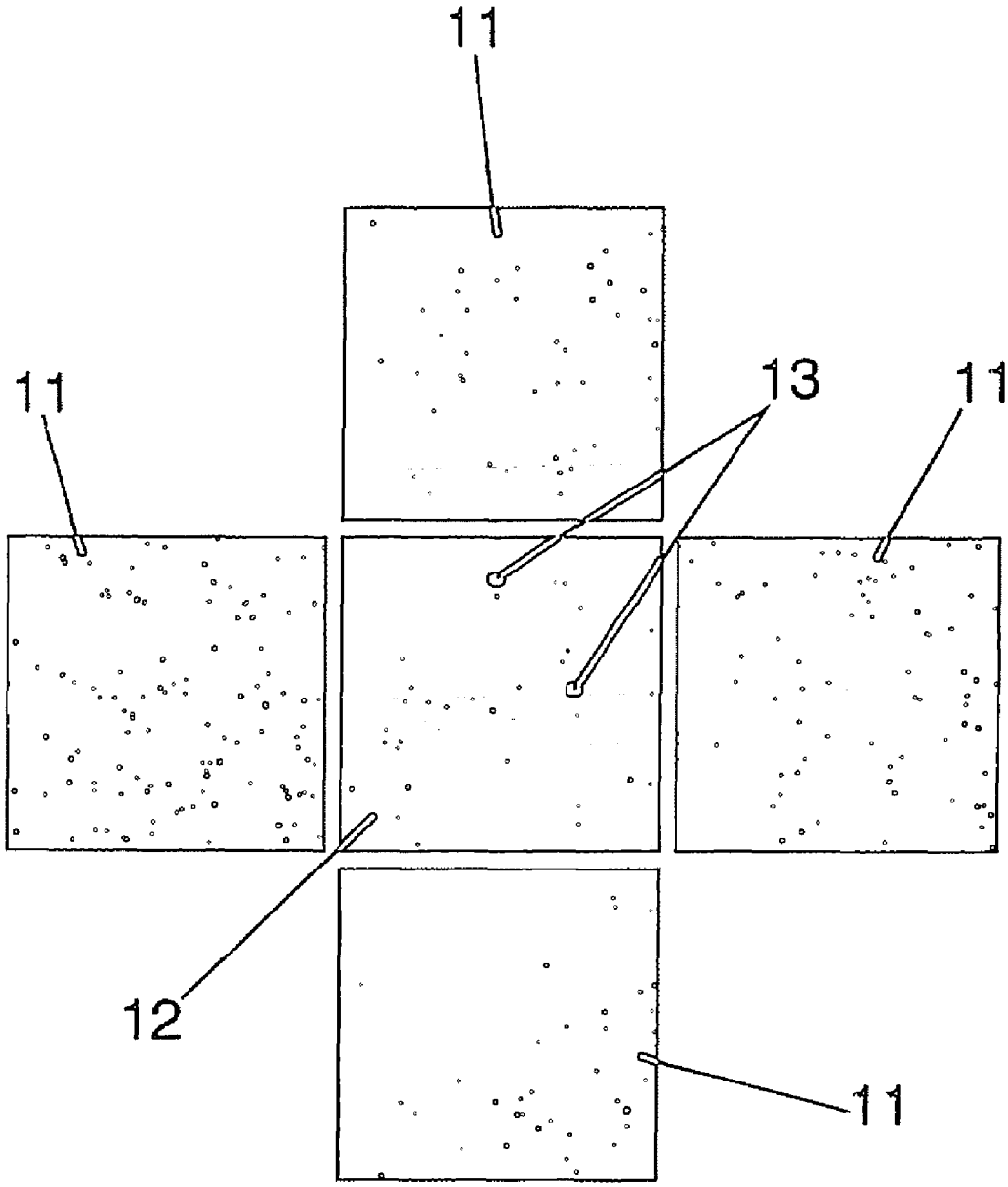
FIG. 3.—Shows a similar embodiment as FIG. 2 but in this case square-shaped patches are used and four parasitic elements are coupled to the central driven element by straight gap. This structure is different from prior art structures because the gap between patches is designed to obtain a resonant frequency with a high-directivity broadside radiation pattern. The operating frequency is more than 20% than that of the fundamental mode, that is, the operating wavelength is 20% smaller than $\lambda_o$ (free-space operating wavelength).

FIG. 3 represent the same scheme as FIG. 2 but in this case several parasitic patches (11) are coupled to the driven patch (12) in order to obtain more bandwidth and directivity. For FIG. 3, two feeding probes (13) are used to excite two orthogonal higher-resonant frequencies with the said high-directivity broadside radiation pattern.

In the embodiments of FIGS. 2 and 3, the operating frequency is larger than 20% of the fundamental mode of the driven patch.

Figure 4:
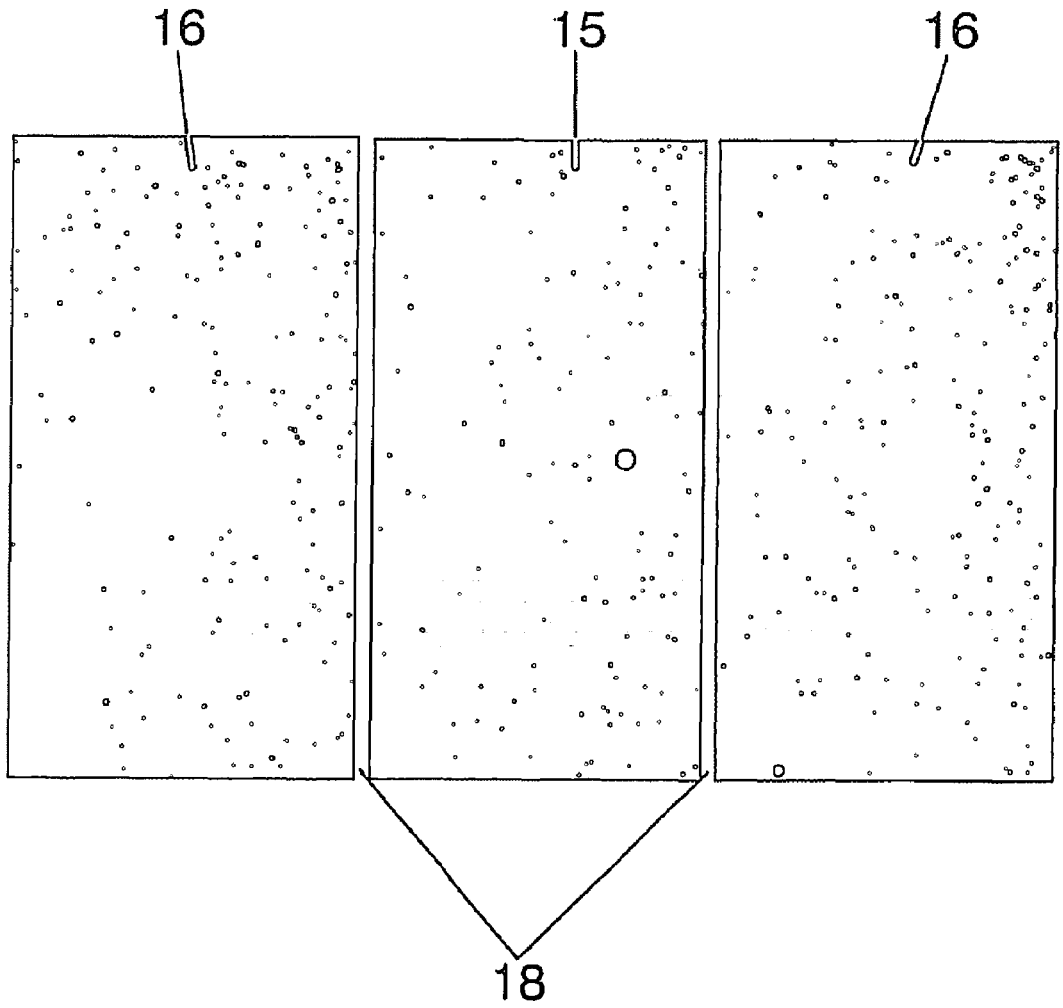
FIG. 4.—Shows a similar embodiment as FIG. 3 but only two parasitic elements are used.

FIG. 4 represent the same scheme as FIG. 2 but in this case two parasitic patches (16) and (17) are coupled to the driven patch (15) through gaps (18).

Figure 5:
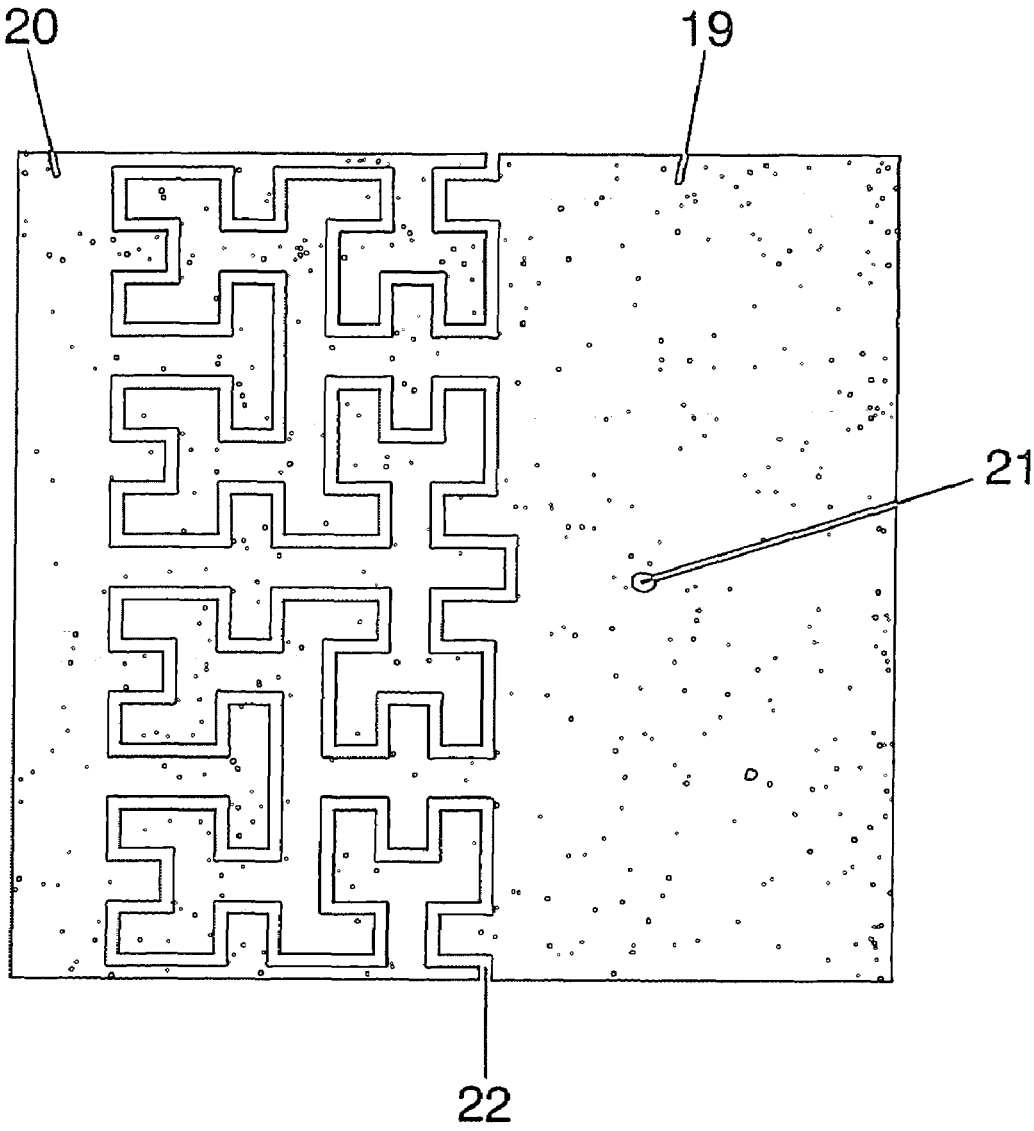
FIG. 5.—Shows a similar embodiment as FIG. 2 but in this case a space-filling gap is used to couple the parasitic patch to the driven one.

In the embodiment of FIG. 5, the driven patch (19) and the parasitic patch (20) are coupled through the gap (22) shaped as a Space-Filling curve. The feeding point (21) is properly placed on the driven patch (19).

In FIG. 6, two parasitic patches (24) and (25) are coupled respectively through gaps (44) and (27) to a central driven patch (23) which is fed in the point (26).

Figure 7:
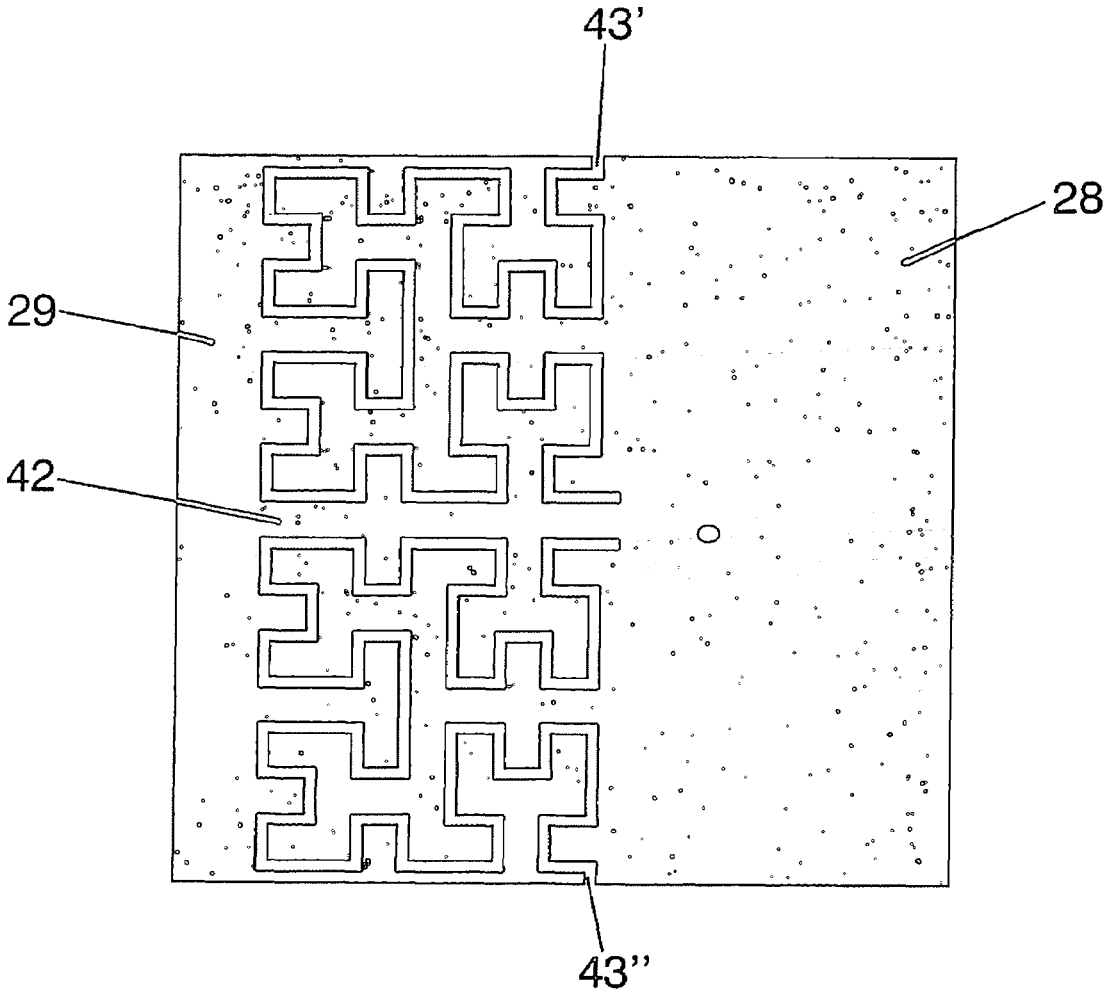
FIG. 7.—Shows a multifunction patch acting as a miniature and a high-directivity antenna. In this embodiment, the entire surface presents continuity to the feed line.

FIG. 7 shows another preferred embodiment for multifunction purposes, in which the driven patch (28) and parasitic patch (29) are in direct contact by means of a short transmission line (42). This is advantageous because it permits one resonant frequency much lower than the fundamental mode of the driven patch with broadside radiation pattern and on the other hand, another resonant frequency with high-directivity features. In the embodiment of FIG. 7, the transmission line (42) lies across the gap between the driven and parasitic patch (28,29), so that the gap is interrupted and two gaps (43' and 43") are formed.

Figure 8:
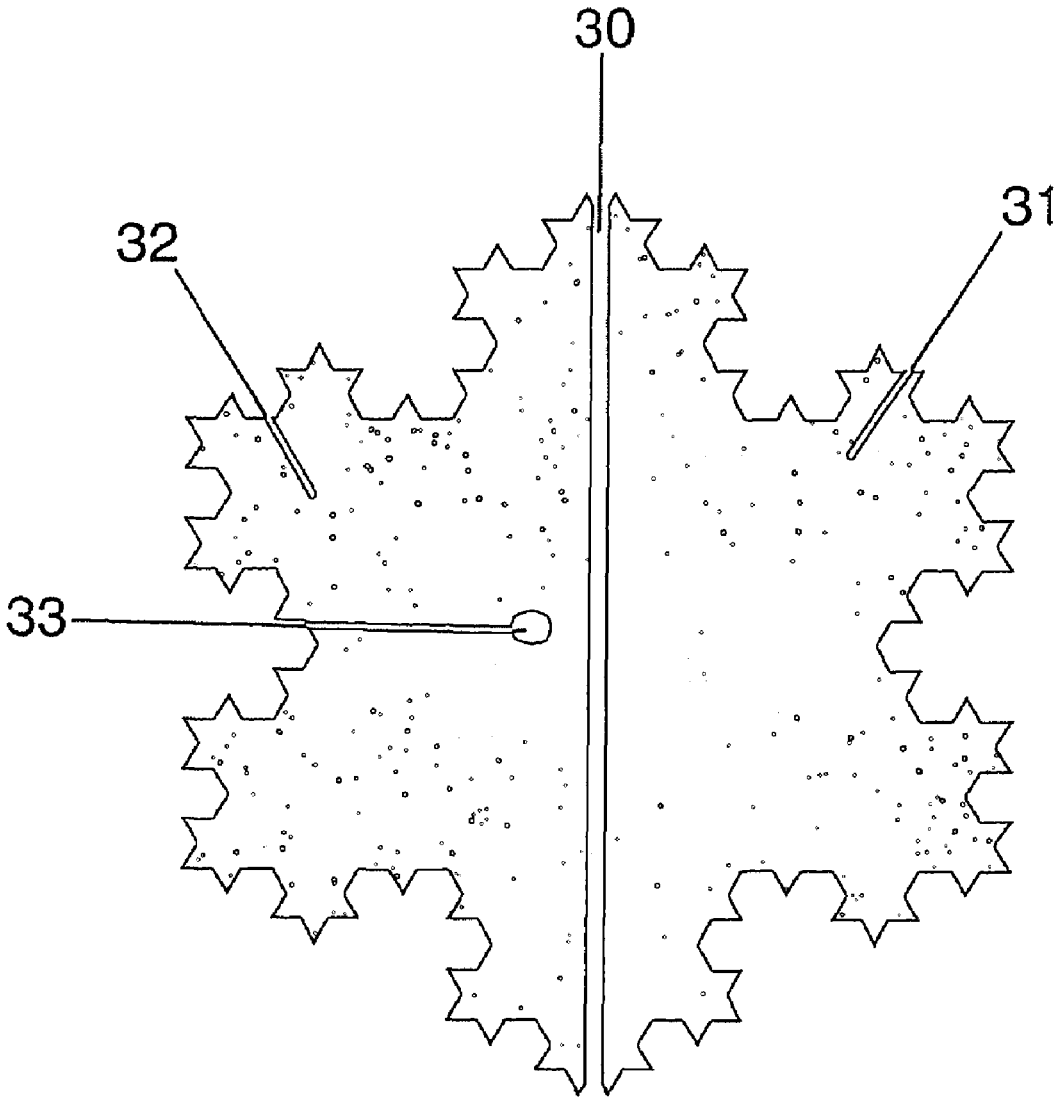
FIG. 8.—Shows a similar embodiment as FIG. 2 but in this case the perimeter of the driven and parasitic patches are defined by a space-filling curve based on the Koch fractal. Both patches are separated by a straight gap.

Space-filling or multilevel geometries may be used to design at least a part of the driven and parasitic patches. FIG. 8 shows another preferred embodiment where a space-filling geometry based on Koch fractal is used to define the perimeter of driven patch (32) and the parasitic patch (31). Both patches (32) and (31) are separated by a straight gap (30). This embodiment is meant to improve the high-directivity features of the present invention. A feeding point (33) can be observed in the driven patch (32).

Figure 9:
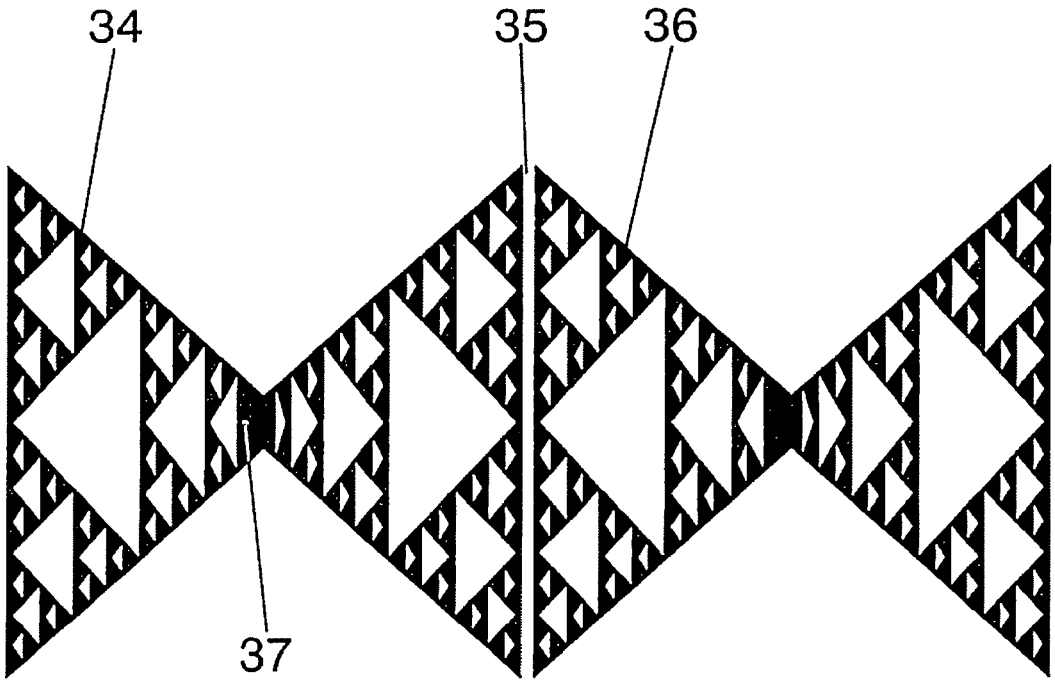
FIG. 9.—Shows a similar embodiment as FIG. 8 but in this case the driven and parasitic patches are multilevel geometries based on the Sierpinski bowtie.

FIG. 9 represents another preferred embodiment where a multilevel geometry based on the Sierpinski bowties is used to shape the driven patch (34) and the parasitic patch (36). A straight gap (35) is defined between the driven and parasitic patches (34,36).

Figure 10:
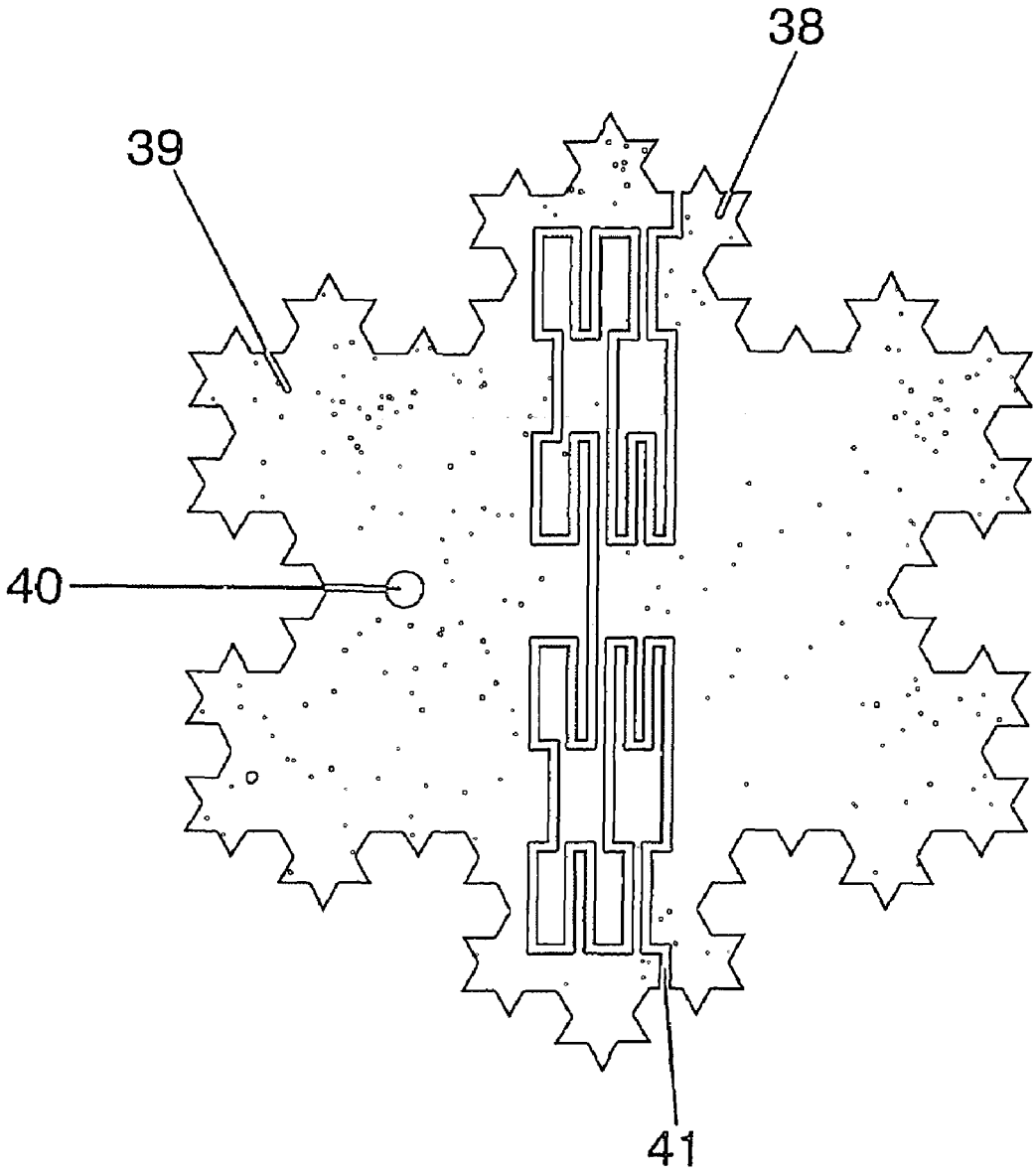
FIG. 10.—Shows a similar embodiment as FIG. 8 but in this case the gap between the driven and parasitic patches is defined by a space-filling curve based on the Hilbert fractal.

The gaps between driven and parasitic patches may be also defined by space-filling curves. For instance, in FIG. 10 the gap (41) between the driven patch (39) and the parasitic patch (38) is based on the Hilbert fractal.

Is to be understood that even though various embodiments and advantages of the present invention have been described in the foregoing description, the above disclosure is illustrative only, and changes may be made in details, yet remain within the spirit and scope of the present invention, which is to be limited only by the appended claims.

The invention claimed is:

1. A high-directivity microstrip patch antenna comprising:

a driven patch and at least one parasitic patch coupled to said driven patch by means of a gap;

the driven and the at least one parasitic patches being placed on a common plane defined by a dielectric substrate;

wherein the driven patch and the at least one parasitic patch operate at a resonant frequency of the antenna that is larger than the antenna's fundamental resonant frequency the operating resonant frequency being determined by the shape and dimensions of said gap for a given size of driven patch and the least one parasitic patch, the gap between the driven patch and the at least one parasitic patch being defined by a space-filling curve, said space-filling curve being a curve comprising at least ten connected segments, wherein each of said segments forms an angle with its neighbors so that no pair of adjacent segments define a larger straight segment, and wherein any portion of the curve that is periodic along a fixed straight direction of space is defined by a non-periodic curve comprising at least ten connected segments in which no pair of adjacent and connected segments define a straight longer segment;

wherein the microstrip patch antenna has a broadside radiation pattern at the operating resonant frequency; and wherein the microstrip patch antenna has a directivity larger at the operating resonant frequency than at the fundamental resonant frequency.

2. An antenna according to claim 1 wherein the operating resonant frequency is at least 20% larger than the fundamental resonant frequency.

3. An antenna according to claim 1 wherein at least a part of the driven patch and at least a part of the parasitic patch or patches are defined by a space-filling curve or a multilevel structure.

4. An antenna according to claim 1 wherein the driven patch and the parasitic patch or patches are connected by a coplanar transmission line across the gap in between, the antenna having a first resonant frequency which is lower than the fundamental resonant frequency of the driven element, and a second resonant frequency higher than said fundamental resonant frequency and at which the high-directivity occurs, the antenna therefore having a dual band operation.

5. An antenna according to claim 1 comprising one driven patch and four parasitic patches, the driven patch having four sides and each one of the parasitic patches being coupled by a gap to one of the sides of the driven patch.

6. An antenna according to claim 1 comprising one driven patch and a parasitic patch, the perimeter of said driven and parasitic patch being defined by the Koch fractal.

7. An antenna according to claim 1 comprising one driven patch and a parasitic patch, wherein the driven and parasitic patch are multilevel geometries based on the Sierpinski bowtie.

8. An antenna according to claim 1 wherein the gap between the driven and parasitic patch or patches is defined by a space-filling curve based on the Hilbert fractal.

9. A method of operating a high-directivity microstrip patch antenna, the antenna comprising a driven patch and at least one parasitic patch coupled to said driven patch by means of a gap, the driven patch and the at least one parasitic patches being placed on a common plane defined by a dielectric substrate, the method comprising;

operating the driven patch and the at least one parasitic patches at a resonant frequency of the antenna that is larger than the antenna's fundamental resonant frequency, the operating resonant frequency being determined by the shape and dimensions of said gap for a given size of the driven patch and at least one parasitic patch;

the gap between the driven patch and the at least one parasitic patch being defined by a space-filling curve, said space-filling curve being a curve comprising at least ten connected segments, wherein each of said segments forms an angle with its neighbors so that no pair of adjacent segments define a larger straight segment, and wherein any portion of the curve that is periodic along a fixed straight direction of space is defined by a non-periodic curve comprising at least ten connected segments in which no pair of adjacent and connected segments define a straight longer segment;

wherein the microstrip patch antenna has a broadside radiation pattern at the operating resonant frequency; and wherein the microstrip patch antenna has a directivity larger at the operating resonant frequency than at the resonant fundamental frequency.

10. A method according to claim 9, wherein the operating resonant frequency is selected to be at least 20% larger than the fundamental resonant frequency.

11. A method according to claim 9, wherein at least a part of the driven patch and at least a part of the parasitic patch or patches are defined by a space-filling curve or a multilevel structure.

12. A method according to claim 9, wherein the driven patch and the parasitic patch or patches are connected by a coplanar transmission line across the gap in between, the antenna having a first resonant frequency which is lower than the fundamental resonant frequency of the driven element, and a second resonant frequency higher than said fundamental resonant frequency and at which the high directivity occurs, the antenna therefore having a dual band operation.

13. A microstrip patch antenna comprising:

a driven patch and at least one parasitic patch;

the driven patch and the at least one parasitic patch being placed on a same plane defined by a dielectric substrate;

the at least one parasitic patch being coupled to the driven patch by means of a gap between the driven patch and the at least one parasitic patch; and the gap being defined by a space-filling curve, said space-filling curve being a curve comprising at least ten connected segments, wherein each of said segments forms an angle with its neighbors so that no pair of adjacent segments define a larger straight segment, and wherein any portion of the curve that is periodic along a fixed straight direction of space is defined by a non-periodic curve comprising at least ten connected segments in which no pair of adjacent and connected segments define a straight longer segment.

14. An antenna according to claim 1, wherein the gap between the driven patch and the at least one parasitic patch has a width smaller than approximately a one-hundred-fiftieth of the wavelength corresponding to the fundamental resonant frequency.

15. A high-directivity microstrip patch antenna comprising:

a driven patch and at least one parasitic patch coupled to said driven patch by means of a gap;

the driven patch and the at least one parasitic patch being placed on a same plane defined by a dielectric substrate;

wherein the driven patch and the at least one parasitic patch operate at a resonant frequency of the antenna that is larger than the antenna's fundamental resonant frequency;

the operating resonant frequency being determined by the shape and dimensions of said gap for given sizes of driven patch and parasitic patch;

the gap between the driven patch and the at least one parasitic patch having a width smaller than approximately 1/150 of the wavelength of the antenna's fundamental resonant frequency;

at least a part of the driven patch and at least a part of the parasitic patch or patches being defined by at least one of a space-filling curve and a multilevel structure;

the microstrip patch antenna having a broadside radiation pattern at the operating resonant frequency; and the microstrip patch antenna having a directivity larger at the operating resonant frequency than at the fundamental resonant frequency.

16. An antenna according to claim 15, wherein the resonant frequency of the antenna is at least 20% larger than the fundamental resonant frequency.

17. An antenna according to claim 15 wherein the gap between the driven patch and parasitic patch or patches is defined by a space-filling curve.

18. An antenna according to claim 15 wherein the gap between the driven patch and parasitic patch or patches is a straight line.

19. An antenna according to claim 15, wherein the driven patch and the parasitic patch or patches are connected by a coplanar transmission line across the gap in between, the antenna having a first resonant frequency which is lower than the fundamental resonant frequency of the driven element, and a second resonant frequency higher than said fundamental resonant frequency and at which the high-directivity occurs, the antenna therefore having a dual band operation.

20. An antenna according to claim 15, comprising one driven patch and four parasitic patches, the driven patch having four sides and each one of the parasitic patches being coupled by a gap to one of the sides of the driven patch.

21. An antenna according to claim 15, comprising one driven patch and a parasitic patch, the perimeter of said driven and parasitic patch being defined by the Koch fractal.

22. An antenna according to claim 15, comprising one driven patch and a parasitic patch, wherein the driven and parasitic patch are multilevel geometries based on the Sierpinski bowtie.

23. An antenna according to claim 15, wherein the gap between the driven and parasitic patch or patches is defined by a space-filling curve based on the Hilbert fractal.

24. A method of operating a high-directivity microstrip patch antenna, the antenna comprising a driven patch and at least one parasitic patch coupled to said driven patch by means of a gap, and the driven patch and the at least one parasitic patch being placed on a common plane defined by a dielectric substrate, the method comprising:

operating the driven patch and the at least one parasitic patch at a resonant frequency of the antenna that is larger than the antenna's fundamental resonant frequency;

the operating resonant frequency being determined by the shape and dimensions of said gap for given sizes of driven patch and parasitic patch;

the gap between the driven patch and the at least one parasitic patch having a width smaller than approximately a one-hundred-fiftieth of the wavelength corresponding to the fundamental resonant frequency;

at least a part of the driven patch and at least a part of the parasitic patch or patches being defined by at least one of a space-filling curve and a multilevel structure;

wherein the microstrip patch antenna has a broadside radiation pattern at the operating resonant frequency; and the microstrip patch antenna has a directivity larger at the operating resonant frequency than at the fundamental resonant frequency.

25. A method according to claim 24, wherein the operating resonant frequency of the antenna is selected to be at least 20% larger than the fundamental resonant frequency.

26. A method according to claim 24, wherein the gap between the driven patch and parasitic patch or patches is defined by a space-filling curve.

27. A method according to claim 24, wherein the gap between the driven patch and parasitic patch or patches is a straight line.

28. A method according to claim 24, wherein the driven patch and the parasitic patch or patches are connected by a coplanar transmission line across the gap in between, the antenna having a first resonant frequency which is lower than the fundamental resonant frequency of the driven element, and a second resonant frequency higher than said fundamental resonant frequency and at which the high-directivity occurs, the antenna therefore having a dual band operation.

* * * * *